US005944613A

United States Patent [19]

Dubois

[11] Patent Number: 5,944,613

[45] Date of Patent: Aug. 31, 1999

[54] GOLF STANCE AND BALL ALIGNMENT PRACTICE AID

[76] Inventor: Enrique Dubois, 3415 McKamy Oaks Trail, Arlington, Tex. 76017-3542

[21] Appl. No.: 09/182,621

[22] Filed: Oct. 29, 1998

[51] Int. Cl.[6] ..... A63B 69/36

[52] U.S. Cl. ..... 473/218; 473/273

[58] Field of Search ..... 473/218, 270, 473/271, 272, 273

[56] References Cited

U.S. PATENT DOCUMENTS

| | | |
|---|---|---|
| 2,575,668 | 11/1951 | Lemoyne . |
| 2,777,697 | 1/1957 | Crossot . |
| 3,658,344 | 4/1972 | Kimble . |
| 4,257,608 | 3/1981 | Funk . |
| 4,354,683 | 10/1982 | Woolland . |
| 4,384,718 | 5/1983 | Cachola . |
| 4,563,010 | 1/1986 | McDorman et al. . |
| 4,583,739 | 4/1986 | Kabbany . |
| 4,925,192 | 5/1990 | Forbes ..... 473/273 |
| 5,203,453 | 4/1993 | Dirito . |
| 5,362,060 | 11/1994 | Hinson . |
| 5,766,101 | 6/1998 | Chaney . |

*Primary Examiner*—George J. Marlo
*Attorney, Agent, or Firm*—John V. Stewart

[57] ABSTRACT

A horizontal tube 1 having a mark 6 for the left foot position, and having a sequence of preferably three marks 3–5 for the right foot position for three ranges of club numbers. A shaft 10 is inserted transversely through the tube via one of three horizontal transverse holes 7–9 corresponding to the ranges of clubs indicated for the right foot. The shaft is tapered from end to end, and stops in a transverse hole at a position depending on the diameter of the hole. This position is designed such that the shaft extends forward a distance appropriate for ball placement for the given range of clubs. For adjustment, the user need only move the shaft to one of three holes. This configures the device for both the lateral and longitudinal placement of the feet relative to the ball, with minimal distraction and concentration.

8 Claims, 4 Drawing Sheets

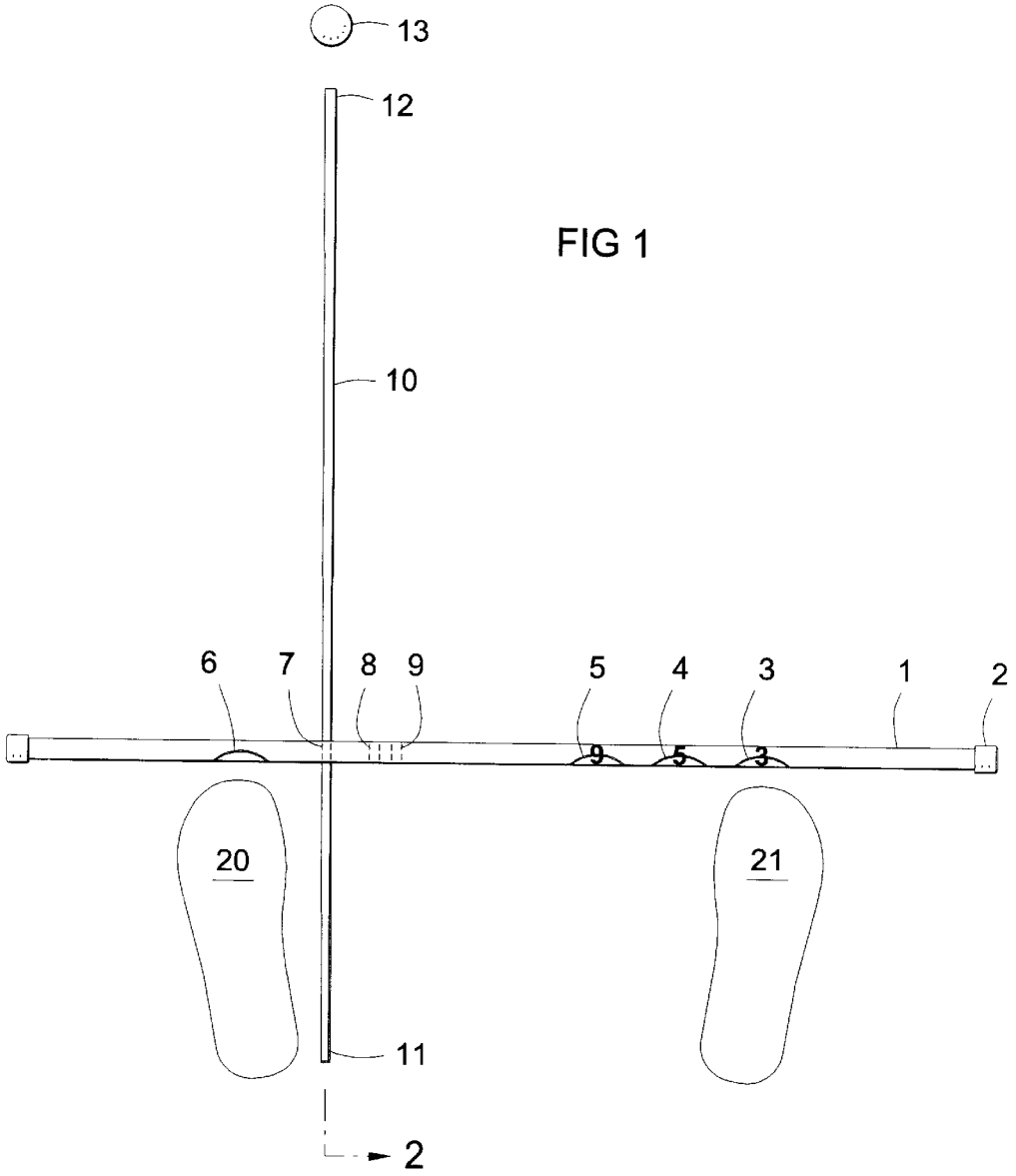
FIG 1
FIG 2
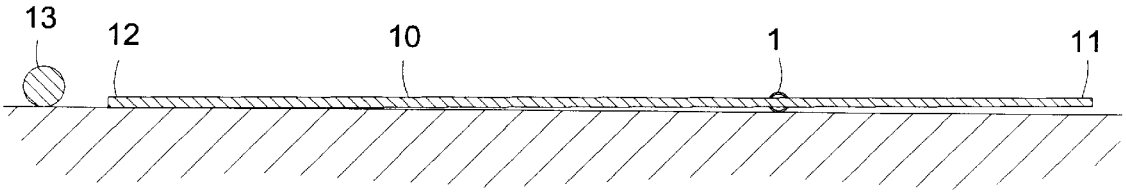

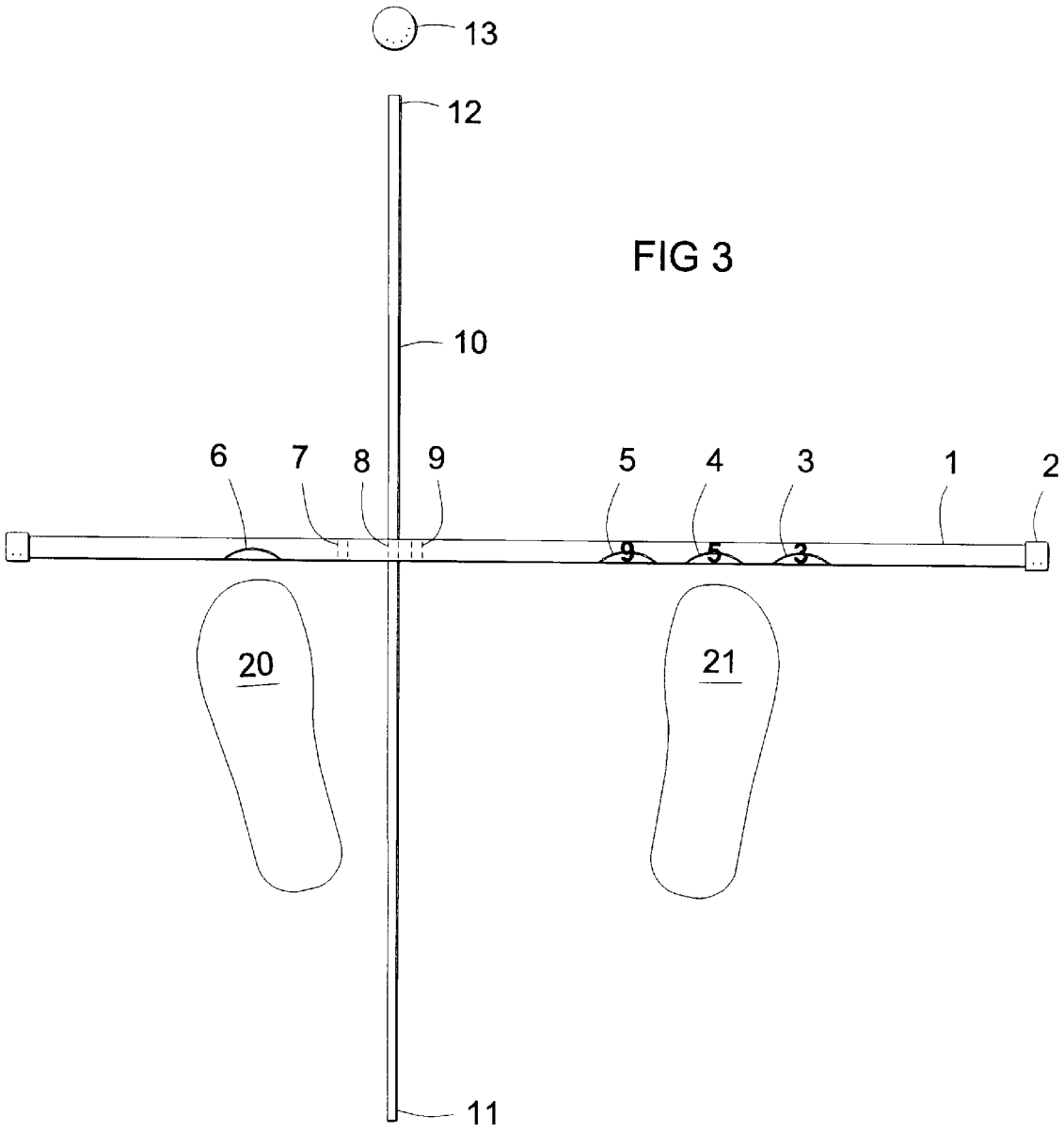
FIG 3
FIG 4
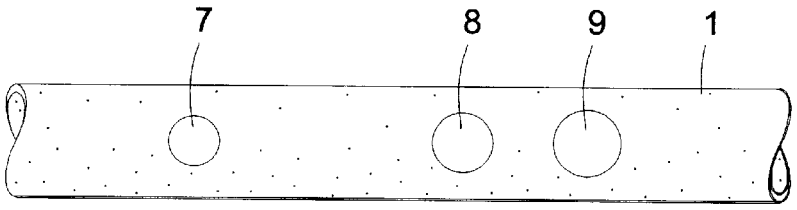

GOLF STANCE AND BALL ALIGNMENT PRACTICE AID

BACKGROUND OF THE INVENTION

1. Field of the Invention

This invention is in the field of golf stance and ball position aids for practice of a golf stroke.

2. Description of Prior Art

Prior U.S. patents disclose several devices for positioning a golfer's stance in relation to a ball to be struck. However, they do not offer the simplicity of manufacture and use provided by the present invention.

For example, U.S. Pat. No. 4,257,608 (Funk) discloses a "Golfer's Setup Device" comprising a pair of rulers, 40 and 80, mounted transversely to each other using an attachment that allows each ruler to slide along its length relative to the attachment. Two foot position and angle strips, 50 and 52, are slidably mounted on the main ruler. This device is highly flexible, but the user must calculate or look-up several angles and distances, slide the rulers to numbers on scales in two dimensions, slide the two foot position indicators to numbers on scales, and set the angles of the foot position strips. The correct numbers and angles for each golf club or range of clubs must be entered and referenced in a table. This is much more complicated to use than the present invention, and the construction is more expensive.

U.S. Pat. No. 4,354,683 (Wooland) discloses a "Golfer's Stance Positioning Aid". It is similar to Funk above, in providing a two-way slide connection between two transverse members, 10 and 12. Indicia on the transverse members are graduated in club numbers. It provides fine incremental adjustability, but is unnecessarily complex to use, since two adjustments must be made for each change of club.

U.S. Pat. No. 4,583,739 (Kabbany) discloses a "Golfer's Stance Positioning Device" comprising two elongated members transversely pivotally connected together. One member has indicia for foot placement per club. The other member is slidable relative to the first member, and indicates its extension from the first member for ball placement per club. It uses a combination pivot and slide connection between the two members which is eliminated in the present invention.

SUMMARY OF THE INVENTION

The objectives of the present invention are to provide a golf stance and ball position practice aid with maximum simplicity and practicality both in construction and use.

These objectives are achieved with a device comprising a horizontal tube with a mark for the left foot position, and a sequence of preferably three marks for the right foot position for three ranges of clubs. A shaft is inserted transversely through the tube via one of three horizontal transverse holes corresponding to the respective range of clubs indicated for the right foot. The shaft is tapered from end to end, and stops in the transverse hole at a position depending on the diameter of the hole. This stop position is designed such that the shaft extends forward a distance appropriate for ball placement for the given range of clubs. The user need only move the shaft to one of three holes. This configures the device for both the lateral and longitudinal placement of the feet relative to the ball, with minimal distraction and concentration.

BRIEF DESCRIPTION OF THE DRAWINGS

FIG. 1 is a top view of the aid as configured for long irons and woods

FIG. 2 is a side sectional view through the tapered shaft along line 2 of FIG. 1

FIG. 3 is a top view of the aid as configured for mid irons

FIG. 4 is a view of the holes in the tube from golfer's side

REFERENCE NUMERALS

Figure 5:
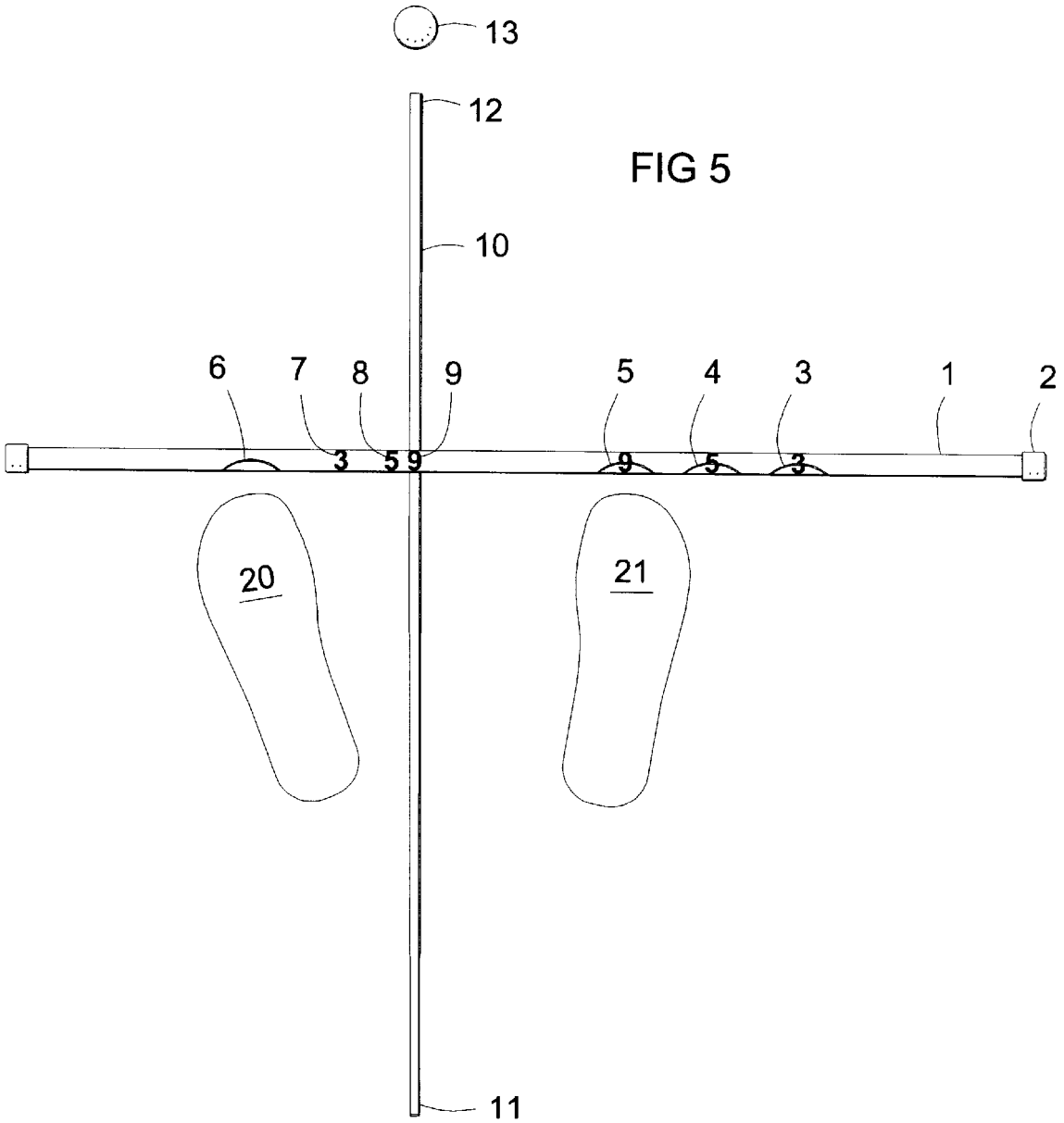
FIG. 5 is a top view of the aid as configured for short irons and wedges

1. Main tube
2. End cap of tube in suggested construction
3. Right foot position mark for long irons and woods
4. Right foot position mark for mid irons
5. Right foot position mark for short irons and wedges
6. Left foot mark
7. Hole in main tube for long irons and woods
7*a*. Entrance hole in wall of tube for through-hole 7
7*b*. Exit hole in wall of tube for through-hole 7
8. Hole in main tube for mid irons
8*a*. Entrance hole in wall of tube for through-hole 8
8*b*. Exit hole in wall of tube for through-hole 8
9. Hole in main tube for short irons and wedges
9*a*. Entrance hole in wall of tube for through-hole 9
9*b*. Exit hole in wall of tube for through-hole 9
10. Transverse shaft, tapered
11. Small end of tapered transverse shaft
12. Large end of tapered transverse shaft
13. Golf ball
15. Alternate transverse shaft, stepped
20. Left foot
21. Right foot

TERMINOLOGY

Left, right, front, and back are in relation to the golfer. The front side of the device is toward the ball, and the left side is to the golfer's left.

DESCRIPTION OF THE PREFERRED EMBODIMENTS

Figure 6:
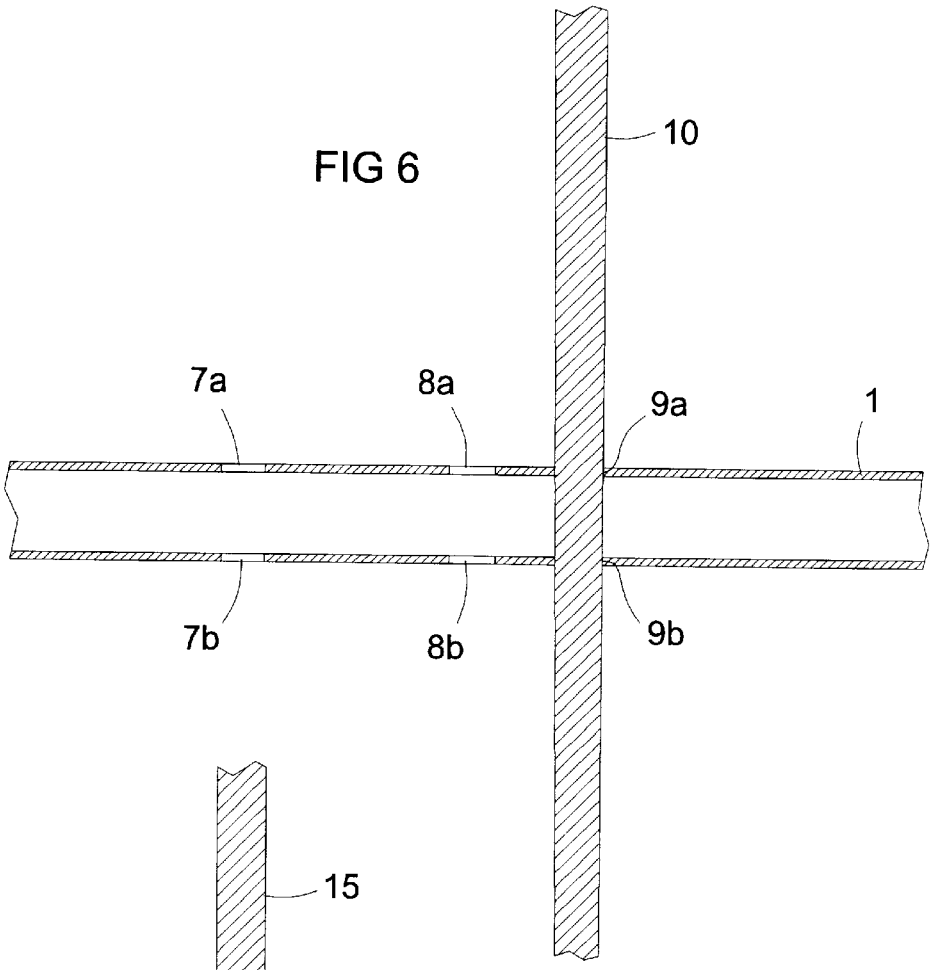
FIG. 6 is an enlarged top sectional view of the interface between the tube and tapered shaft as configured for short irons and wedges

FIG. 1 shows a top view of the invention from the golfer's viewpoint. A horizontal main tube 1 has three transverse horizontal holes 7, 8, and 9, which are progressively larger in diameter from the left side of the tube, as shown in FIGS. 4 and 6. A tapered shaft 10 is inserted by its small end 11 through a selected one of the holes. The shaft is pushed through the hole until it stops where its diameter equals that of the hole. The diameter of the holes, and the varying diameter of the shaft, are so configured that the shaft extends a specified distance forward toward the ball. This extension distance is different for each hole, which configures the device for a given range of golf club numbers. Preferably, the shaft is inserted through the holes from the front as shown. However, this is a design choice, and the shaft can optionally be configured for insertion from the golfer's side.

The shaft extends both forward and backward through the main tube. The forward end of the shaft points to the placement of a golf ball to be struck. The backward extension of the shaft limits the position of the left heel for proper relation to the ball. The main tube has half-round marks 3, 4, 5, and 6 on its upper surface to indicate toe placements. Mark 6 is for placement of the left toe for all clubs. Marks 3, 4, and 5 are right foot placements to be used with holes 7, 8, and 9 respectively. Mark 3 is the right foot position indicator for long irons and woods, mark 4 is the right foot position indicator for mid irons, and mark 5 is the right foot position indicator for short irons and wedges. They are preferably labeled with the middle number in the range of golf clubs to be used at each position (for example, clubs 3, 5, and 9, as shown). The three holes can be correspondingly numbered as shown in FIG. 5. The three configurations of the device are shown in FIGS. 1, 3, and 5.

This device is used for training the stance and stroke of a golfer. The golfer inserts the transverse shaft into the hole appropriate for the club to be used. The device is laid on the ground in front of the golfer, and a golf ball is placed just beyond the forward extension of the shaft. The left toe is placed at mark 6. The right toe is placed at the appropriate mark 3, 4, or 5 for the club being used. Practice balls are struck using this aid, until the golfer memorizes the proper stance for each club.

In the preferred embodiment, the main tube 1 is about 914 mm (36 in.) long and 19 mm (0.75 in.) in outer diameter, and the transverse shaft 10 is about 914 mm (36 in.) long. The three holes 7, 8, and 9 are preferably centered at the following respective distances from the left end of the main tube: 295 mm (11.6 in.), 340 mm (13.4 in.), and 360 mm (14.2 in.). The hole diameters are such that the shaft, when inserted to its stopping point, extends forward from holes 7, 8, and 9 the following respective distances: 610 mm (24 in.), 419 mm (16.5 in.), and 343 mm (13.5 in.). For example, the diameter of hole 7*a* is the same as the diameter of the tapered shaft 10 at a distance of 610 mm (24 in.) from its large end. Since the holes are through a tube, each through-hole comprises a pair of aligned holes, one in each side of the tube (such as 7*a* and 7*b* in FIG. 6). The diameters of each pair of opposed holes preferably differ at the same rate as the shaft, so the shaft stops against each hole simultaneously without slack on either side of the tube.

Toe position marks for a left-handed golf stroke are preferably applied to the bottom side of the main tube in mirror image to the toe marks on the top of the tube, so it can be turned over for left-handed use.

A suggested material for construction of the main tube 1 and the end caps 2 is PVC. Suggested materials for the shaft are wood, fiberglass, or steel. Other materials and structures may be used at the designers preference. For example, the main tube can be embodied as a solid wooden dowel instead of a tube.

Figure 7:
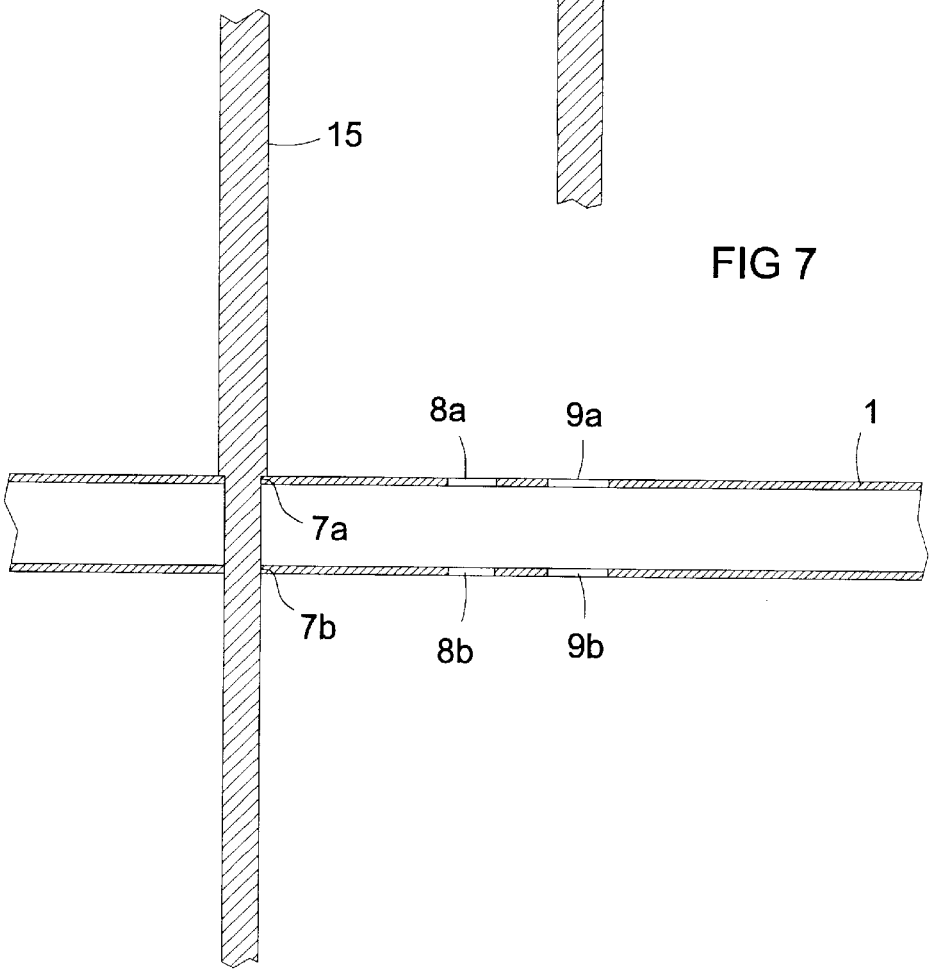
FIG. 7 is an enlarged top sectional view of the interface between the tube and an alternate stepped shaft as configured for long irons and woods.

An alternate embodiment is shown in FIG. 7. The transverse shaft 15 is progressively stepped at three points instead of tapered. Each hole 7, 8, and 9, has a slightly larger diameter than a respective section of the shaft. Each hole blocks the step to the next larger shaft diameter to provide a solid stopping point at the desired shaft position. The two parts of each hole (for example 7*a,* and 7*b*) are the same diameter on both sides of the main tube. This embodiment allows a left-handed golfer to reverse the shaft direction without turning the main tube over. The toe marks will be correct, but will be seen upside-down in this configuration, so a second set of toe marks is preferred, as previously described.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A golf stance and ball alignment practice aid, comprising;

a first elongated horizontal member having front, top, and back sides, and left and right ends;

a left foot position mark on the top side of the first horizontal member;

a sequence of right foot position marks on the top side of the first horizontal member;

a sequence of horizontal transverse holes through the first horizontal member spaced along a portion of the first horizontal member between the left foot mark and the right foot marks, each hole having a diameter, and the sequence of holes having progressively larger diameters from left to right;

a second horizontal member having a large end, a small end, a length, and a varying diameter from end to end;

the diameter of each of the holes being greater than the diameter of the second horizontal member over part of the length of the second horizontal member, and less than the diameter of the second horizontal member over another part of the length of the second horizontal member;

whereby the second horizontal member can be inserted through a given one of the holes to a unique stopping point against the diameter of the given hole, and the second horizontal member will then be mounted transversely through the first horizontal member.

2. The golf stance and ball alignment practice aid of claim 1, wherein the second horizontal member is tapered from end to end, and the diameter of each hole matches the diameter of the second horizontal member at a given position on the length of the second horizontal member.

3. The golf stance and ball alignment practice aid of claim 1, wherein the second horizontal member is stepped from end to end.

4. The golf stance and ball alignment practice aid of claim 1, wherein the sequence of holes comprise at least first, second, and third holes; the sequence of right foot marks comprise at least first, second, and third right foot marks, and the foot position marks and holes are arranged in the following order from the left end of the first horizontal member: left foot mark, first hole, second hole, third hole, third right foot mark, second right foot mark, and first right foot mark.

5. The golf stance and ball alignment practice aid of claim 4, wherein the left foot mark is centered approximately 216 mm (8.5 in.) from the left end of the first horizontal member, the first hole is centered approximately 295 mm (11.6 in.) from the left end of the first horizontal member, the second hole is centered approximately 340 mm (13.4 in.) from the left end of the first horizontal member, the third hole is centered approximately 360 mm (14.2 in.) from the left end of the first horizontal member, the first right foot mark is centered approximately 699 mm (27.5 in.) from the left end of the first horizontal member, the second right foot mark is centered approximately 622 mm (24.5 in.) from the left end of the first horizontal member, and the third right foot mark is centered approximately 572 mm (22.5 in.) from the left end of the first horizontal member.

6. The golf stance and ball alignment practice aid of claim 1, wherein the shaft is tapered from end to end, and the diameter of each hole matches the shaft diameter at a given position on the length of the shaft.

7. The golf stance and ball alignment practice aid of claim 1, wherein the shaft is stepped from end to end.

8. A golf stance and ball alignment practice aid, comprising;

a horizontal tube having front, top, and back sides, and left and right ends;

a left foot position mark on the top side of the tube;

a sequence of right foot position marks on the top side of the tube;

a sequence of horizontal transverse holes through the tube spaced along a portion of the tube between the left foot mark and the right foot marks, each hole having a diameter, and the sequence of holes having progressively larger diameters from left to right;

a shaft having a large end, a small end, a length, and a varying diameter from end to end;

the diameter of each of the holes being greater than the diameter of the shaft over part of the length of the shaft, and less than the diameter of the shaft over another part of the length of the shaft;

whereby the shaft can be inserted through a given one of the holes to a unique stopping point against the diameter of the given hole, and the shaft will then be mounted transversely through the tube.

* * * * *